US008137489B2

(12) United States Patent
Muroga et al.

(10) Patent No.: US 8,137,489 B2
(45) Date of Patent: Mar. 20, 2012

(54) COPPER ALLOY MATERIAL AND A METHOD FOR FABRICATING THE SAME

(75) Inventors: Takemi Muroga, Tsuchiura (JP); Noboru Hagiwara, Tsuchiura (JP); Yoshiki Yamamoto, Tsukuba (JP)

(73) Assignee: Hitachi Cable, Ltd., Tokyo (JP)

( * ) Notice: Subject to any disclaimer, the term of this patent is extended or adjusted under 35 U.S.C. 154(b) by 118 days.

(21) Appl. No.: 12/457,727

(22) Filed: Jun. 19, 2009

(65) Prior Publication Data

US 2010/0224292 A1 Sep. 9, 2010

(30) Foreign Application Priority Data

Mar. 5, 2009 (JP) ..... 2009-051563

(51) Int. Cl.

| | |
|---|---|
| ***C22F 1/08*** | (2006.01) |
| *C22C 9/02* | (2006.01) |
| *C22C 9/04* | (2006.01) |
| *C22C 9/06* | (2006.01) |

(52) U.S. Cl. ..... 148/682; 148/433; 148/434; 148/435

(58) Field of Classification Search ..... 148/682, 148/433, 434, 435

See application file for complete search history.

(56) References Cited

U.S. PATENT DOCUMENTS

| | | | | |
|---|---|---|---|---|
| 2007/0051441 | A1 | 3/2007 | Takano et al. | |
| 2009/0035174 | A1 * | 2/2009 | Era et al. | 420/473 |
| 2010/0037996 | A1 | 2/2010 | Takano et al. | |

FOREIGN PATENT DOCUMENTS

| | | | |
|---|---|---|---|
| JP | 2005-298920 | A | 10/2005 |
| JP | 2007-70651 | A | 3/2007 |
| JP | 2008-13836 | A | 1/2008 |
| WO | WO 2006101172 | A1 * | 9/2006 |

OTHER PUBLICATIONS

Copper and Copper Alloy Fundamentals and Industrial Technology, 1988, 4 pages, partial translation 6 pages, Japan Copper and Brass Association.

Nagashima, Texture, Jan. 20, 1984, 3 pages, partial translation 4 pages, Maruzen Col, Ltd.

Kamijo et al., Surface Textures in Rolled Aluminum Sheets, Journal of the Japan Institute of Metals, vol. 36, 1972, 10 pages, partial translation 9 pages.

* cited by examiner

*Primary Examiner* — Jessica L Ward
*Assistant Examiner* — Alexander Polyansky
(74) *Attorney, Agent, or Firm* — Foley & Lardner LLP

(57) ABSTRACT

A copper alloy material has a rolled surface having a plurality of crystal faces parallel to the rolled surface. The crystal faces includes at least one crystal face selected from a group consisted of {011}, {1nn} (n is an integer, n≧1), {11m} (m is an integer, m≧1), {023}, {012}, and {135}. Diffraction intensities of the crystal faces in an inverse pole figure obtained by crystal diffraction measurement of the rolled surface as a reference satisfy the relationships of:

{011}>{155}>{133},

{011}>{023}>{012}, and

{011}>{135}>{112}.

10 Claims, 10 Drawing Sheets

COPPER ALLOY MATERIAL AND A METHOD FOR FABRICATING THE SAME

The present application is based on Japanese Patent Application No. 2009-051563 filed on Mar. 5, 2009, the entire contents of which are incorporated herein by reference.

BACKGROUND OF THE INVENTION

1. Field of the Invention

The present invention relates to a copper alloy material and a method for fabricating the same, in more particular, to a copper alloy material with excellent bending characteristics and a method for fabricating the same.

2. Related Art

In recent years, parts or components used for various electric and/or electronic devices have been miniaturized in accordance with miniaturization, reduction in thickness, and lightweighting of the various electric and/or electronic devices. Further, the miniaturization and the reduction in a pitch between electrodes of a terminal or connector of the parts have been desired in accordance with the miniaturization of the parts or components. Thickness of electrode materials for various parts is reduced compared with that in conventional electrode materials, as a result of the miniaturization of such a part. Herein, it is required to use a material with high spring property as the material of the electrode and the like, so as to keep reliability in electrical connection even in a thin electrode. In order to securely provide the high spring property, it is necessary to sufficiently increase strength and proof stress of the material.

Furthermore, in accordance with the miniaturization of the parts, it is also demand to fabricate parts with complicated shapes by an integral molding. Therefore, materials that can be applied to bending process under a severe condition are strongly demanded. In addition, Joule heats generated in the electrode and the like are increased by the effect of an increase in the number of the electrodes and an increase in electric current to be supplied, in accordance with provisions of higher functions of the electric or electronic devices. Therefore, a demand for using the materials with excellent electric conductivity compared with the conventional materials is increased. In other words, it is required that the materials composing the terminals or connector parts used for the electric or electronic devices have excellent electric conductivity as well as high strength, high proof stress and excellent bending characteristics.

As a conventional material with the high strength, excellent electric conductivity and low cost, a copper alloy such as Cu—Ni—Si based alloy has been used. For example, Japanese Patent Laid-Open No. 2008-13836 (JP-A 2008-13836) discloses a copper alloy sheet which comprises Ni and Si, and further comprises Sn and Mg as needed, the balance being Cu, in which a ratio of a diffraction intensity obtained from {220} of the copper alloy sheet to a diffraction intensity obtained from {220} of a pure copper standard powder and a ratio of a diffraction intensity obtained from {200} of the copper alloy sheet to a diffraction intensity obtained from {200} in the pure copper standard powder that are obtained by 2θ/θ measurement by X-ray diffraction are determined to fall within respective predetermined ranges.

JP-A 2008-13836 provides the copper alloy sheet in which anisotropy in the tensile strength and bending characteristics are improved.

However, in the copper alloy sheet disclosed by JP-A 2008-13836, since the diffraction intensities in specific crystal faces are used for 2θ/θ measurement by the X-ray diffraction, only a partial information of plural crystal faces that are parallel to a surface of the copper alloy sheet is obtained, so that there is the case where the bending characteristics of the copper alloy sheet cannot be appropriately controlled.

SUMMARY OF THE INVENTION

Accordingly, an object of the present invention is to provide a copper alloy material with high strength, high proof stress, high electrical conductivity and good bending characteristics.

According to a feature of the invention, a copper alloy material comprises:

a rolled surface comprising a plurality of crystal faces parallel to the rolled surface, the crystal faces including at least one crystal face selected from a group consisted of {011}, {1nn} (n is an integer, n≧1), {11m} (m is an integer, m≧1), {023}, {012}, and {135}, wherein diffraction intensities of the crystal faces in an inverse pole figure obtained by crystal diffraction measurement of the rolled surface as a reference satisfy the relationships of:

{011}>{155}>{133},

{011}>{023}>{012}, and

{011}>{135}>{112}.

The copper alloy material may comprise:

Ni, Si, and the balance being Cu and inevitable impurities.

The copper alloy material may comprise:

at least one element selected from a group consisted of Zn, Sn and P; and

Ni, Si, and the balance being Cu and inevitable impurities.

According to another feature of the invention, a method for fabricating a copper alloy material comprises:

hot rolling process of hot rolling an ingot comprising a copper alloy to manufacture a sheet of the copper alloy;

cold rolling process of cold rolling the sheet;

solution treatment process of carrying out a solution treatment on the sheet after the cold rolling process; and finish cold rolling process of cold rolling the sheet after the solution treatment process, wherein the cold rolling process comprising cold rolling passes for plural times, wherein an area reduction ratio of the sheet in an initial cold rolling pass is greater than any of area reduction ratios of other cold rolling passes.

The method for fabricating a copper alloy material may further comprise:

an aging treatment process of carrying out an aging treatment on the sheet after the finish cold rolling process.

The method for fabricating a copper alloy material may further comprise:

an aging treatment process of carrying out an aging treatment on the sheet after the solution treatment process.

ADVANTAGES OF THE INVENTION

According to the present invention, it is possible to provide a copper alloy material with high strength, high proof stress, high electrical conductivity and good bending characteristics.

DETAILED DESCRIPTION OF THE PREFERRED EMBODIMENT

Figure 1A:
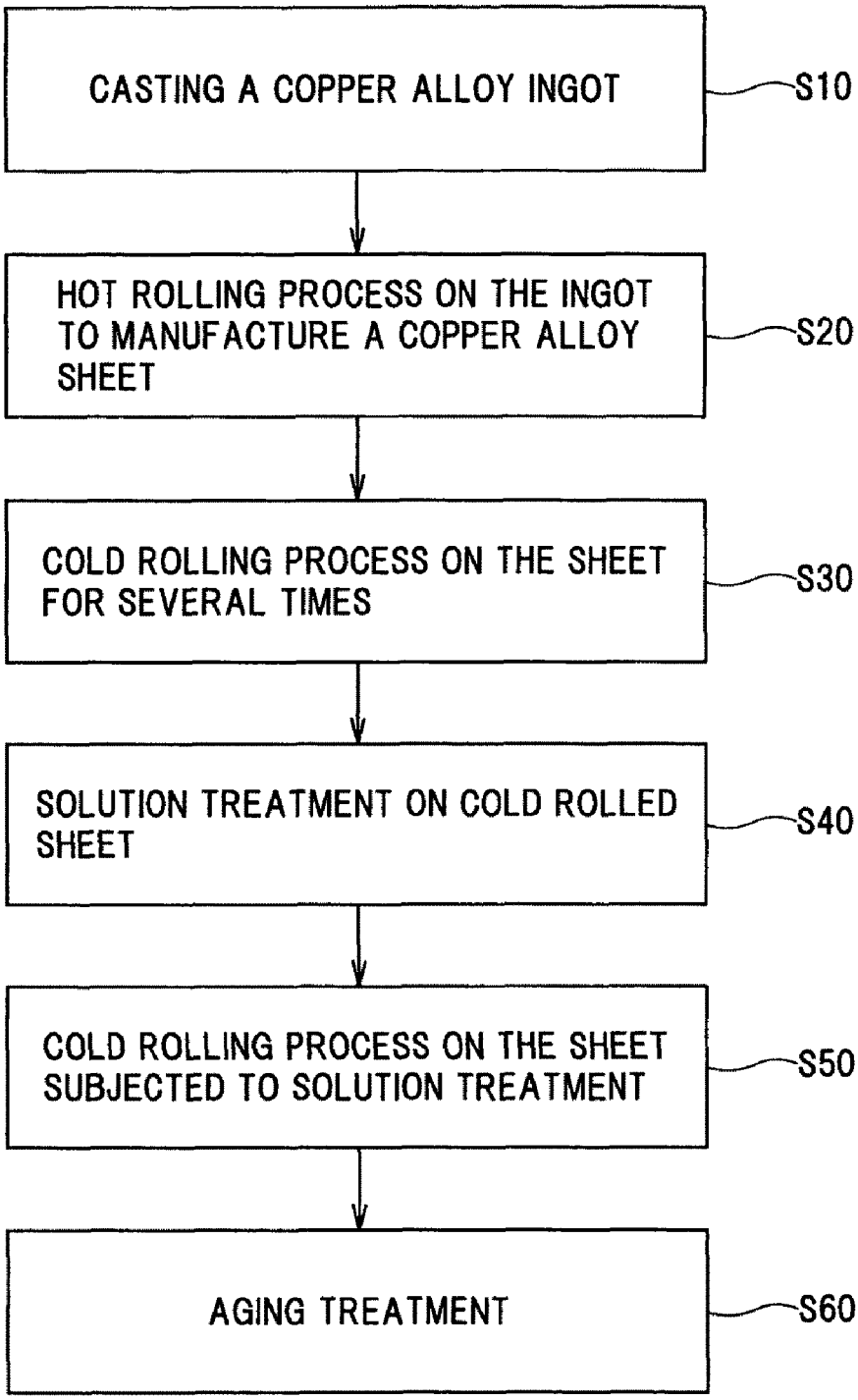
FIG. 1A is a flow chart showing a manufacturing process of a copper alloy material in a preferred embodiment according to the present invention.

Next, a preferred embodiment according to the present invention will be explained in more detail in conjunction with appended drawings.

A copper alloy material in the preferred embodiment according to the present invention is based on Inventors' contemplation as described below. In other words, the present invention is a result of the Inventors' zealous studies about an alloy material showing the excellent bending characteristics from a point of view of crystal orientation control of alloy materials. More concretely, the alloy material fabricated by rolling process comprises plural crystal faces on a rolled surface. Further, it is possible to obtain the alloy material with good bending characteristics as well as high strength, high proof stress and high electrical conductivity by controlling diffraction intensities in crystal diffraction measurement of respective crystal faces that are parallel to the rolled surface of the alloy material to be arranged in a predetermined order. In the preferred embodiment as described below, a Cu—Ni—Si based copper alloy material is explained as an example of copper alloy materials that are alloy materials.

Preferred Embodiment (A brief Summary of Copper Alloy Material)

A Cu—Ni—Si based copper alloy material in the preferred embodiment according to the present invention comprises a copper alloy material fabricated by rolling process, and a rolled surface formed by the rolling process, in which a rolled surface comprises plural crystal faces that are parallel to rolled surface, and the crystal faces include at least one crystal face selected from a group consisted of {011}, {1nn} (n is an integer, n≧1), {11m} (m is an integer, m≧1), {023}, {012}, and {135}.

Herein, {hkl} expresses all of crystal faces that are symmetrically equivalent to (hkl). More concretely, since a crystal structure of copper, copper alloy or the like composing the Cu—Ni—Si based copper alloy material in the preferred embodiment is a cubic system, {hkl}, {khl} and {klh} are crystal faces that are equivalent to each other. For example, when the crystal face is expressed as {100}, {100} includes all of (100), (010), (001), (−100), (0-10), and (00-1). In addition, both {001} and {010} are also equivalent to {100}.

In addition, in the crystal face {hkl}, crystal faces {h×n k×n l×n} that are integral multiplication (n is an integer) of {hkl} are parallel to each other. By way of example only, {011} and {022} are parallel to each other, and {012} and {024} are parallel to each other. In this preferred embodiment, the crystal faces are expressed with the smallest integer. Furthermore, in this preferred embodiment, the order of indices h, k, and l of {hkl} is unified as h≦k≦l and with the smallest integer.

In the rolled surface of the Cu—Ni—Si based copper alloy material in the preferred embodiment, diffraction intensities of the crystal faces satisfy relationships of {011}>{155}>{133}, {011}>{023}>{012}, and {011}>{135}>{112} in an inverse pole figure obtained by the crystal diffraction measurement of the rolled surface as a reference.

In addition, the Cu—Ni—Si based copper alloy material in the preferred embodiment comprises Ni, Si, and the balance being Cu and inevitable impurities. More concretely, the copper alloy material comprises Ni of 2.0 to 3.5% by weight, Si of 0.35 to 0.85% by weight, and the balance being Cu and inevitable impurities.

Herein, the Cu—Ni—Si based copper alloy material is not limited to the aforementioned example. The Cu—Ni—Si based copper alloy may be formed from at least one element selected from a group consisted of Zn, Sn and P, further Ni, Si and the balance being Cu and the inevitable impurities. More concretely, the copper alloy material comprises Ni of 2.0 to 3.5% by weight, Si of 0.35 to 0.85% by weight, at least one element selected from the group consisted of Zn, Sn and P of 3.0% or less by weight, and the balance being Cu and inevitable impurities.

(The Crystal Diffraction Measurement)

Herein, the crystal diffraction measurement is carried out by using X-ray or electron beam on the rolled surface of a sample that is an object to be measured as a reference. As to the crystal diffraction measurement, the X-ray and the electron beam are distinguished from each other in penetration depth when incident on the sample. In other words, the difference between the X-ray and the electron beam is an information amount in a depth direction among the information obtained from the sample that was used. In the case of using the X-ray in the crystal diffraction measurement, it is possible to obtain the information of several micrometers (μm) to several dozens of micrometers (μm) in the depth direction. On the other hand, in the case of using the electron beam in the crystal diffraction measurement, the information in the depth direction is varied according to the purpose of measurement. For example, it is possible to obtain the information until a depth about 30 nm to 50 nm in Electron Backscatter Diffraction Pattern (EBSD or EBSP).

In this preferred embodiment, the expression "the rolled surface . . . as a reference" means that the rolled surface is directly measured when carrying out the crystal diffraction measurement using the electron beam. Further, when carrying out the crystal diffraction measurement using the X-ray, the object to be measured is inclined with only an angle defined as a tilt angle (an angle of inclining the object to be measured), the X-ray is irradiated to the object to be measured to carry out the crystal diffraction measurement in this state. Namely, "the rolled surface . . . as a reference" means the measuring of the X-ray diffraction generated at a particular tilt angle with respect to the crystal faces that are parallel to the rolled surface.

In addition, if the crystal condition of the sample is substantially uniform over the whole of the sample, the same results of the crystal diffraction measurement are obtained both in the case of using the X-ray and the case of using the electron beam. The Cu—Ni—Si based copper alloy material in the preferred embodiment comprises the crystal condition of substantially uniform over the whole. Therefore, in the Cu—Ni—Si based copper alloy material in the preferred embodiment (e.g. products fabricated by mass-production), the substantially same results of the crystal diffraction measurement are obtained both in the case of using the X-ray and the case of using the electron beam. On the other hand, in the copper alloy material in a variation of the preferred embodiment (e.g. a copper alloy material for trial manufacturing, and a copper alloy material for studies), the crystal condition may be varied along the depth direction of the copper alloy material, so that there may be a case that the result of the crystal diffraction measurement using the X-ray and the result of the crystal diffraction measurement using the electron beam are different from each other. Furthermore, when the crystal condition at a surface of the rolled surface of the copper alloy material is different from the crystal condition at an inner part of the copper alloy material, the result of the crystal diffraction measurement using the X-ray and the result of the crystal diffraction measurement using the electron beam are different from each other Since the Cu—Ni—Si based copper alloy material in the preferred embodiment comprises the substantially uniform crystal condition over the whole, the substantially same results of the crystal diffraction measurement are obtained in both of the case of using the X-ray and the case of using the electron beam. Therefore, in this preferred embodiment, the crystal diffraction measurement using the electron beam diffraction is principally explained. To be concrete, the EBSD measurement is carried out on the rolled surface of the copper alloy material to obtain a diffraction pattern (generally referred to as "Kikuchi pattern"), thereby providing information of crystal faces of each crystal grain at the rolled surface. Herein, OIM Data Collection Ver 0.5 (a product made by TSL Solution Co., Ltd.) may be used as a measurement control software. Further, based on information of the crystal faces of each crystal grain at the rolled surface, it is possible to draw an inverse pole figure. Herein, OIM Analysis Ver 0.5 (a product made by TSL Solutions Co., Ltd.) may be used as a software for drawing an inverse pole figure. Further, SEM (type: SU-70, product made by Hitachi, Ltd.), EBSD (a product made by TSL Solutions Co., Ltd.) or the like may be used as a measuring apparatus.

(Brief Explanation of the Inverse Pole Figure)

As a method for displaying a distribution or the like of the crystal faces of a certain object to be measured, there are pole figure and inverse pole figure. The pole figure is a plane figure display in which a sample axis of the sample to be measured is fixed, by which it is possible to read three-dimensional state of the crystal face. On the other hand, the inverse pole figure is a plane figure display in which a crystal axis of the sample to be measured is fixed. In this preferred embodiment, the inverse pole figures are used. The Cu—Ni—Si based copper alloy material in the preferred embodiment comprises a copper material, in which respective diffraction intensities of {011}, {155}, {133}, {023}, {012}, {112} and {135} among the plural crystal faces are controlled to establish the relationships as described above.

(Manufacturing Process of the Copper Alloy Material)

FIG. 1A is a flow chart showing a manufacturing process of a copper alloy material in a preferred embodiment according to the present invention.

At first, materials of elements that should be included in the copper alloy material to be fabricated and an oxygen-free copper are prepared. An amount of each element is determined in accordance with a composition ratio of the element included in the copper alloy material to be fabricated. Then, the materials and the oxygen-free copper thus prepared are melt in a high frequency fusion furnace, and an ingot of copper alloy is cast (casting process: Step 10, and a "Step" will be abbreviated as "S" hereinafter).

Next, the ingot is hot rolled to manufacture a copper alloy sheet (hot rolling process: S20).

Successively, the copper alloy sheet is cold rolled. In this preferred embodiment, the cold rolling is repeatedly carried out on the copper alloy sheet for plural times (Cold rolling process: S30).

In this preferred embodiment, the cold rolling process comprises cold rolling steps including plural cold rolling passes. To be concrete, the cold rolling process comprises a first cold rolling step of processing a copper alloy sheet with a thickness of $t_0$ ($t_0$ is a thickness of the copper alloy sheet before the cold rolling process) into a copper alloy sheet with a thickness of $t_1$ ($t_0>t_1$). Herein, the first cold rolling step comprises plural cold rolling passes for cold rolling the copper alloy sheet with the thickness of $t_0$ into the copper alloy sheet with the thickness of $t_1$ gradually (i.e. in stages).

Further, in this preferred embodiment, following the first cold rolling step, a second cold rolling step of processing the copper alloy sheet with the thickness of $t_1$ into a copper alloy sheet with a thickness of $t_2$ ($t_1>t_2$) and a third rolling step of processing the copper alloy sheet with the thickness of $t_2$ into a copper alloy sheet with a thickness of $t_3$ ($t_2>t_3$) may be carried out. Herein, the cold rolling steps may be repeated for m-times (m is an integer, $m \geqq 2$) until the copper alloy sheet with the thickness of $t_0$ is reduced in thickness into a copper alloy sheet with a thickness of $t_n$ (n is a positive integer, $t_0>t_n$).

The plural cold rolling passes are carried out such that at least an area reduction ratio of the sheet in an initial cold rolling pass (for the first time) is greater than any of area reduction ratios of other cold rolling passes excluding the initial cold rolling pass. In other words, the area reduction ratio of the sheet in the cold rolling pass for the first time is the greatest. By way of example only, the plural cold rolling passes are carried out such that an area reduction ratio of the sheet in one of the cold rolling passes is equal to or greater than an area reduction ratio of the sheet in another cold rolling pass following the one cold rolling pass. In addition, the number of times for carrying out the cold rolling on the sheet (i.e. the number of times of the cold rolling passes) is at least two, i.e. the cold rolling is repeated for not less than twice until a thickness $t_x$ of the sheet before the cold rolling is reduced to a predetermined thickness $t_{x+1}$ (x is an integer, $x \geqq 0$). In other words, the cold rolling in the cold rolling passes for plural number times is carried out in such a manner than the area reduction ratio of the sheet is gradually reduced in accordance with an increase in the number of times of the cold rolling passes, or at least the area reduction ratio of the sheet in the one cold rolling pass is not greater than the area reduction ratio of the sheet in the cold rolling pass just before the one cold rolling pass.

Next, a solution treatment is carried out on the copper alloy sheet passed through the cold rolling process (Solution treatment process: S40).

Successively, another cold rolling process is carried out on the copper alloy sheet after the solution treatment (Finish cold rolling process: S50).

Furthermore, an aging treatment is carried out on the copper alloy sheet passed through the finish cold rolling process (Aging treatment process: S60).

The Cu—Ni—Si based copper alloy material in the preferred embodiment is provided by passing through the above-mentioned processes.

Variation of the Preferred Embodiment

Figure 1B:
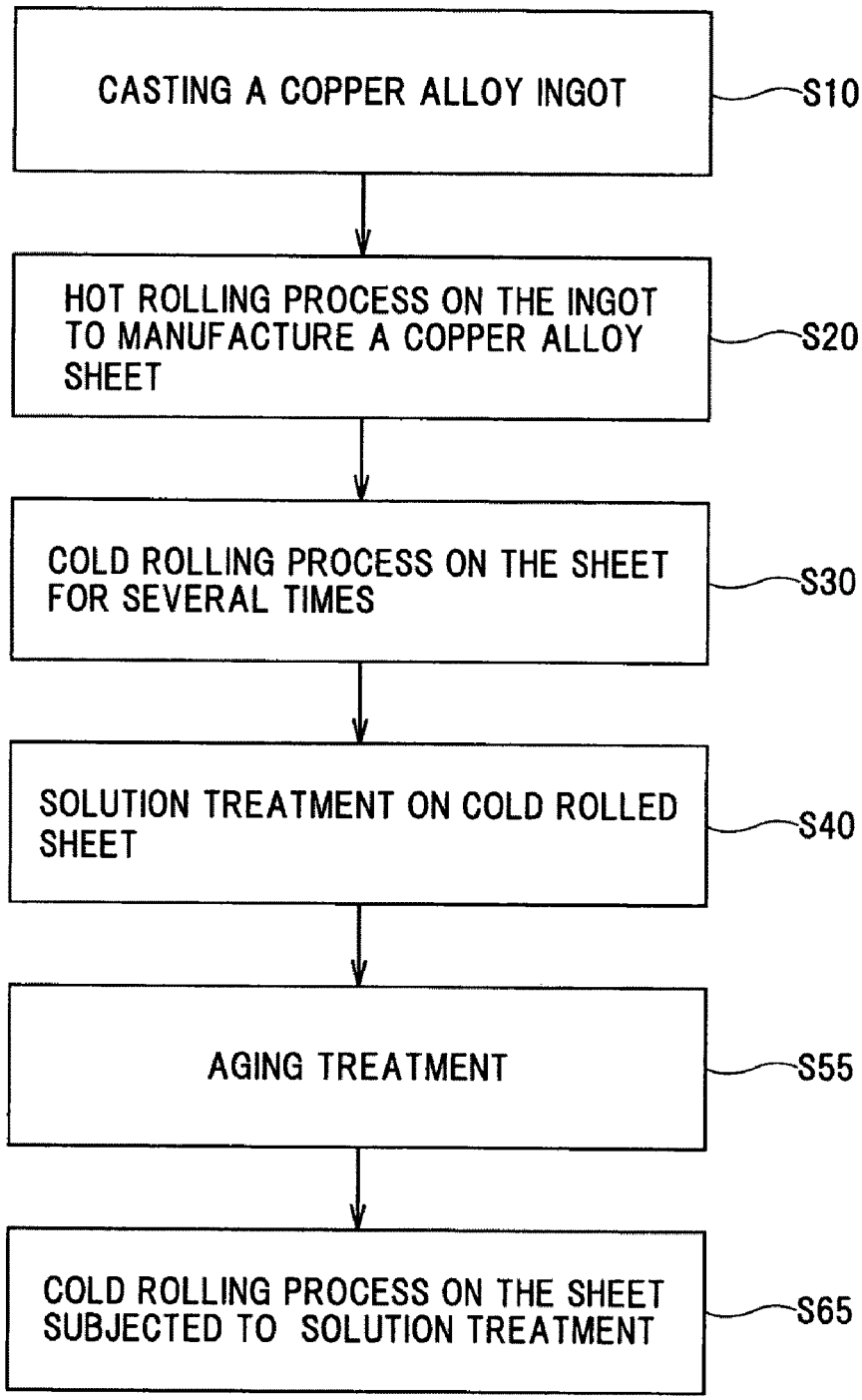
FIG. 1B is a flow chart showing a manufacturing process of a copper alloy material in a variation of the preferred embodiment according to the present invention.

FIG. 1B is a flow chart showing a manufacturing process of a copper alloy material in a variation of the preferred embodiment according to the present invention.

A manufacturing process of the copper alloy material in the variation of the preferred embodiment is similar to that in the preferred embodiment except that a process after the solution treatment process in the variation is different from that in the preferred embodiment. Therefore, detailed description thereof is omitted except the difference.

In the manufacturing process of the copper alloy material in the variation of the preferred embodiment, after the solution treatment process (S40), an aging treatment is firstly carried out on the sheet after the solution treatment (Aging treatment process: S55).

Next, a cold rolling process is carried out on the sheet after the solution treatment and the aging treatment was carried out (Finish cold rolling process: S65).

According to this process, a Cu—Ni—Si based copper alloy material is provided similarly to the preferred embodiment.

(Other Variations)

In this preferred embodiment, the Cu—Ni—Si based copper alloy material (also called as "Corson series copper alloy material") was explained. However, the alloy materials are not limited to the Cu—Ni—Si based copper alloy material, as far as the diffraction intensities of the crystal faces parallel to the rolled surface in the inverse pole figure satisfy the relationships as described above. By way of example only, phosphor bronze, brass, beryllium copper and other alloys may be used. In addition, the X-ray may be used in the crystal diffraction measurement.

Effect of the Preferred Embodiment

The Cu—Ni—Si based copper alloy material in the preferred embodiment according to the present invention comprises the copper alloy material fabricated by rolling process, and the rolled surface formed by the rolling process, in which the rolled surface comprises the plural crystal faces that are parallel to the rolled surface, and the crystal faces include at least one crystal face selected from a group consisted of {011}, {1nn} (n is an integer, n≧1), {11m} (m is an integer, m≧1), {023}, {012}, and {135}. In the rolled surface of the Cu—Ni—Si based copper alloy material in the preferred embodiment, the diffraction intensities of the crystal faces satisfy the relationships of {011}>{155}>{133}, {011}>{023}>{012}, and {011}>{135}>{112} in the inverse pole figure obtained by the crystal diffraction measurement of the rolled surface as a reference. Accordingly, it is possible to provide the copper alloy material excellent in bending characteristics as well as strength, proof stress, and electric conductivity. Therefore, the copper alloy material in the preferred embodiment may be provided for the application of the terminals or connectors used in the small-sized electric or electronic devices In addition, since the copper alloy material in the preferred embodiment of the present invention has excellent bending characteristics as well as high strength and high proof stress, it is possible to easily respond to the miniaturization of the connectors or terminals used in the electric or electronic devices, thereby largely improving a degree of freedom for design of the electric or electronic devices.

Furthermore, as far as the rolled surface comprises the plural crystal faces that are parallel to the rolled surface, and the crystal faces include at least one crystal face selected from a group consisted of {011}, {1nn} (n is an integer, n≧1), {11m} (m is an integer, m≧1), {023}, {012}, and {135}, and the diffraction intensities of the crystal faces satisfy the relationships of {011}>{155}>{133}, {011}>{023}>{012}, and {011}>{135}>{112} in the inverse pole figure of the crystal faces parallel to the rolled surface, it is possible to provide the alloy material with excellent bending characteristics as well as high strength and high proof stress regardless of alloy composition.

Embodiments

Next, the copper alloy materials in Examples and copper alloy materials in comparative examples will be explained below.

A method for fabricating the copper alloy in the Examples and that in the comparative examples are substantially similar. At first, materials of the elements that should be included in the copper alloy material to be fabricated and an oxygen-free copper were prepared. An amount of each element thus prepared is determined in accordance with a composition ratio of each of the elements included in the copper alloy material to be fabricated. TABLE 1 shows compositions of copper alloy materials in Examples 1 to 8 and the copper alloy materials in comparative examples 1 to 8.

TABLE 1

| | Composition (% by weight)*[1] | | | | | |
|---|---|---|---|---|---|---|
| | Ni | Si | Zn | Sn | P | Cu and inevitable impurities |
| Example 1 | 3.5 | 0.85 | — | — | — | Balance |
| Comparative Example 1 | | | | | | |
| Example 2 | 3.3 | 0.7 | 1.7 | — | — | Balance |
| Comparative Example 2 | | | | | | |
| Example 3 | 3.3 | 0.7 | 1.7 | 0.3 | — | Balance |
| Comparative Example 3 | | | | | | |
| Example 4 | 3.5 | 0.85 | 2.0 | 0.98 | 0.02 | Balance |
| Comparative Example 4 | | | | | | |
| Example 5 | 2.0 | 0.35 | — | — | — | Balance |
| Comparative Example 5 | | | | | | |
| Example 6 | 2.0 | 0.46 | 1.7 | — | — | Balance |
| Comparative Example 6 | | | | | | |
| Example 7 | 2.0 | 0.46 | 2.5 | 0.5 | — | Balance |
| Comparative Example 7 | | | | | | |
| Example 8 | 2.0 | 0.35 | 2.3 | 0.65 | 0.05 | Balance |
| Comparative Example 8 | | | | | | |

*[1]A total of a percentage by weight of Zn, a percentage by weight of Sn and a percentage by weight of P is not greater than 3% by weight.

Next, the oxygen-free copper and alloying elements were melt in the high frequency fusion furnace to provide each of the composition ratios of the copper alloy materials in TABLE 1, and an ingot with a thickness of 20 mm, a width of 50 mm, and a length of 250 mm was cast (Casting process). Next, the ingot was heated to 850° C., and hot rolled to manufacture a sheet with a thickness of 8 mm (Hot rolling process). Successively, the sheet with the thickness of 8 mm was cold rolled until the thickness of the sheet becomes 0.25 mm (Cold rolling process). After the cold rolling process, the cold rolled sheet was kept at a temperature of 750° C. to 850° C. for one minute, and thrown in water and cooled to a room temperature (about 20° C.) at a rate of about 300° C./minute (Solution treatment process). Furthermore, the cooled sheet was cold rolled until the thickness of the sheet becomes 0.2 mm (Finish cold rolling process). Furthermore, the sheet processed by the finish cold rolling process was kept at a temperature of 450° C. for four hours (Aging treatment process).

Herein, a difference between the Examples and the comparative examples is a condition in the cold rolling process of cold rolling the sheet from the thickness of 8 mm to the thickness of 0.25 mm. In other words, while the Examples and the comparative examples are similar to each other in that the cold rolling process comprises plural cold rolling steps and each cold rolling step includes plural cold rolling passes, they are different from each other in a condition of the cold rolling pass. To be concrete, the Examples and the comparative examples are different from each other in the area reduction ratio in the cold rolling pass.

To be concrete, the condition of the cold rolling process in the Examples is prescribed below. The cold rolling process was controlled such that the area reduction ratio per cold rolling pass in the first cold rolling step of cold rolling the sheet with the thickness of 8 mm into the thickness of 2.5 mm was determined to be within a range from 15% to 25%, and that the area reduction ratio of the cold rolling pass next to one cold rolling pass was not greater than the area reduction ratio of the one cold rolling pass. The cold rolling process was further controlled such that the area reduction ratio per cold rolling pass in the second cold rolling step of cold rolling the sheet with the thickness of 2.5 mm into the thickness of 1.0 mm was determined to be within a range of 10% to 20%, and that the area reduction ratio of a cold rolling pass next to one cold rolling pass was not greater than the area reduction ratio of the one cold rolling pass (the current cold rolling pass). The cold rolling process was still further controlled such that the area reduction ratio per cold rolling pass in the third cold rolling step of cold rolling the sheet with the thickness of 1.0 mm into the thickness of 0.25 mm was determined to be within a range from 15% to 25%, and that the area reduction ratio of the cold rolling pass next to one cold rolling pass was not greater than the area reduction ratio of the one cold rolling pass.

In addition, in the finish cold rolling process after the solution treatment process, the cold rolling of reducing the thickness of 0.25 mm into the thickness of 0.2 mm was carried out by the cold rolling pass for twice. Herein, the finish cold rolling process was controlled such that the area reduction ratio of the second cold rolling pass was not greater than the area reduction ratio of the first cold rolling pass, and that a total area reduction ratio was 20%.

On the other hand, in a method for fabricating the copper alloy material in the comparative examples, an area reduction ratio of each of the plural cold rolling passes in the cold rolling process was not particularly controlled. The case that one of the cold rolling passes is greater than the specified range of the area reduction ratio in the Examples, or the case that the area reduction ratio in the cold rolling pass next to one cold rolling pass is greater than the area reduction ratio in the one cold rolling pass are included in the comparative examples.

TABLE 2 shows a working condition of the cold rolling process in the Examples and the comparative examples.

TABLE 2

| | | Cold rolling process (Area reduction ratio) | | |
|---|---|---|---|---|
| | | First cold rolling step [t8 mm→t2.5 mm] | Second cold rolling step [t2.5 mm→t1 mm] | Third cold rolling step [t1 mm→t0.25 mm] |
| Examples 1 to 8 | First cold rolling pass | t8 mm→t6 mm (25%) | T2.49 mm→t1.99 mm (20%) | T1.0 mm→t0.75 mm (25%) |
| | Second cold rolling pass | T6 mm→t4.68 mm (22%) | T1.99 mm→t1.63 mm (18%) | T0.75 mm→t0.59 mm (22%) |
| | Third cold rolling pass | T4.68 mm→t3.70 mm (21%) | T1.63 mm→t1.34 mm (18%) | T0.585 mm→t0.462 mm (21%) |
| | Fourth cold rolling pass | T3.70 mm→t3.0 mm (19%) | T1.34 mm→t1.15 mm (14%) | T0.462 mm→t0.365 mm (21%) |
| | Fifth cold rolling pass | T3.0 mm→t2.49 mm (17%) | T1.15 mm→t1.0 mm (13%) | T0.365 mm→t0.299 mm (18%) |
| | Sixth cold rolling pass | — | — | T0.299 mm→t0.248 mm (17%) |
| Comparative examples 1 to 8 | First cold rolling pass | t8 mm→t6 mm (25%) | T2.49 mm→t1.87 mm (25%) | T1.0 mm→t0.72 mm (28%) |
| | Second cold rolling pass | T6 mm→t4.8 mm (20%) | T1.87 mm→t1.51 mm (19%) | T0.72 mm→t0.547 mm (24%) |
| | Third cold rolling pass | T4.8 mm→t3.74 mm (22%) | T1.51 mm→t1.19 mm (21%) | T0.547 mm→t0.41 mm (25%) |
| | Fourth cold rolling pass | T3.74 mm→t3.1 mm (17%) | T1.19 mm→t1.0 mm (16%) | T0.41 mm→t0.303 mm (26%) |
| | Fifth cold rolling pass | T3.1 mm→t2.49 mm (20%) | — | T0.303 mm→t0.249 mm (18%) |

TABLE 2 shows that cold rolling process was carried out in order of the first cold rolling step, the second cold rolling step, and the third cold rolling step. In addition, as to the plural cold rolling passes in each cold rolling step, TABLE 2 shows that the cold rolling process were carried out in order of the first cold rolling pass, the second cold rolling pass, . . . the n-th cold rolling pass (n is an integer, n≧1). The working condition of the cold rolling process is different between the method for fabricating the copper alloy material in the Examples and the method for fabricating the copper alloy material in the comparative examples as described above, however the other conditions are the same.

(Measuring Result of the Rolled Surfaces of the Copper Alloy Materials in the Examples and the Comparative Examples)

FIGS. 2A to 2D are inverse pole figures of the copper alloy materials in the Examples 1 to 4, and FIGS. 3A to 3D are inverse pole figures of the copper alloy materials in the comparative examples 1 to 4.

To be concrete, the rolled surface of each of the copper alloy materials fabricated by the above-described process was measured by the EBSD method. FIGS. 2A to 2D respectively show the measuring result, i.e. diffraction intensity distribution of the crystal faces parallel to the rolled surface (inverse pole figure). FIGS. 2A to 2D are respectively inverse pole figures of respective copper alloy materials in the Examples 1 to 4. FIGS. 3A to 3D are respectively inverse pole figures of respective copper alloy materials in the comparative examples 1 to 4.

Figure 2A:
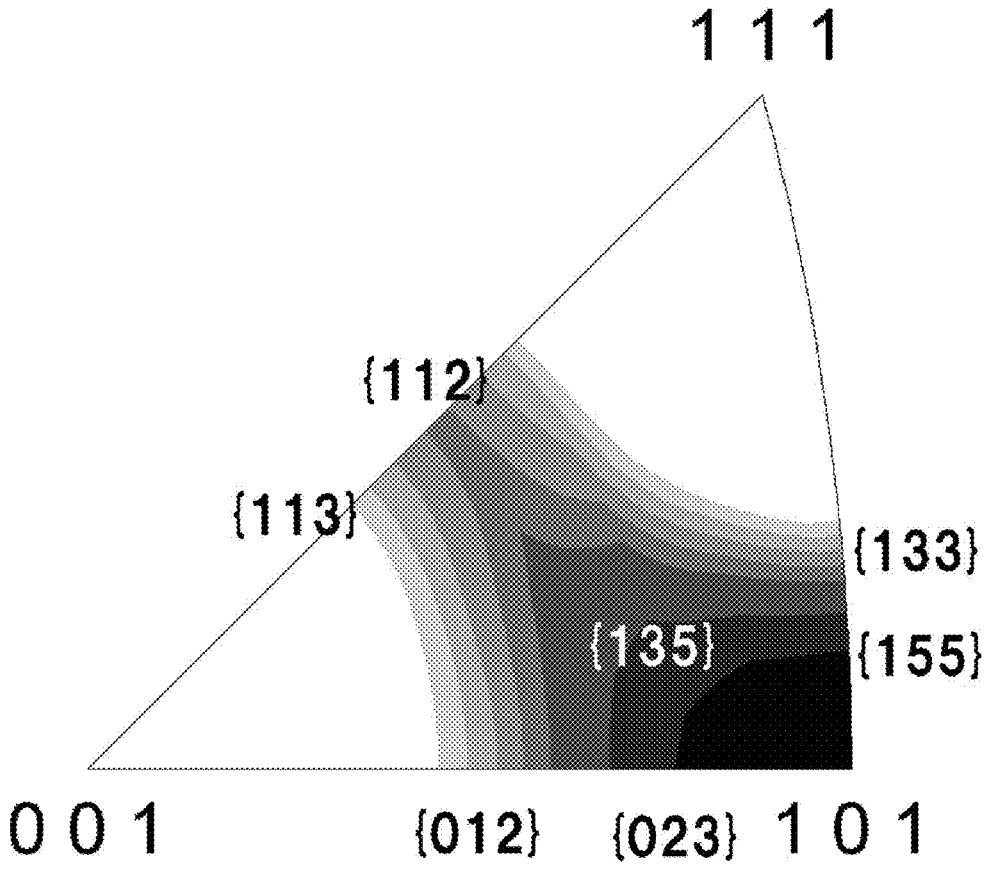
FIG. 2A is an inverse pole figure of a copper alloy material in Example 1.
Figure 2B:
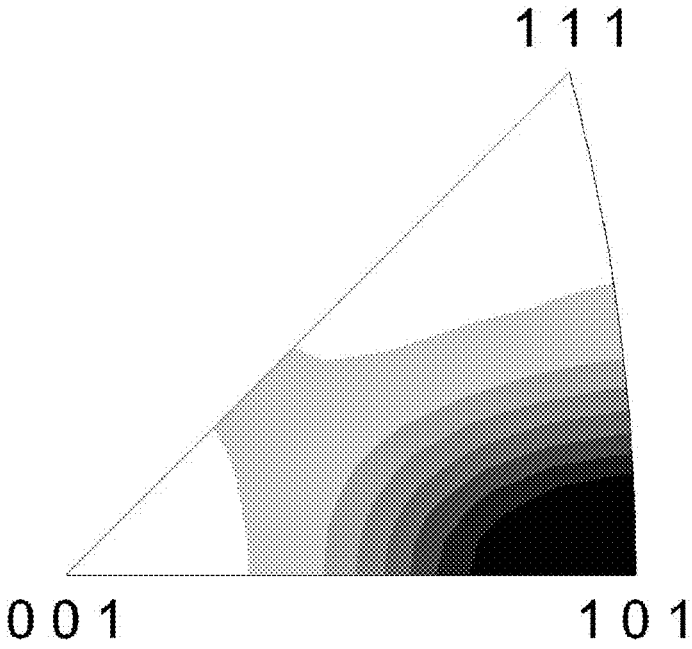
FIG. 2B is an inverse pole figure of a copper alloy material in Example 2.
Figure 2C:
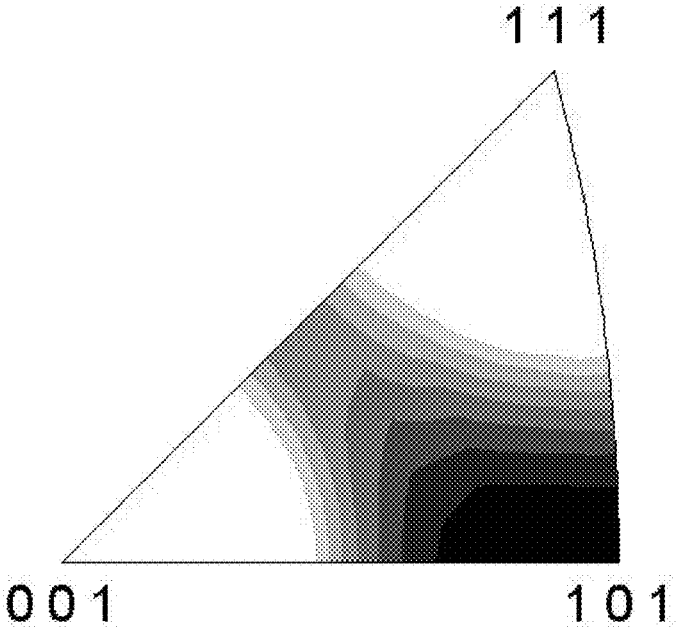
FIG. 2C is an inverse pole figure of a copper alloy material in Example 3.
Figure 2D:
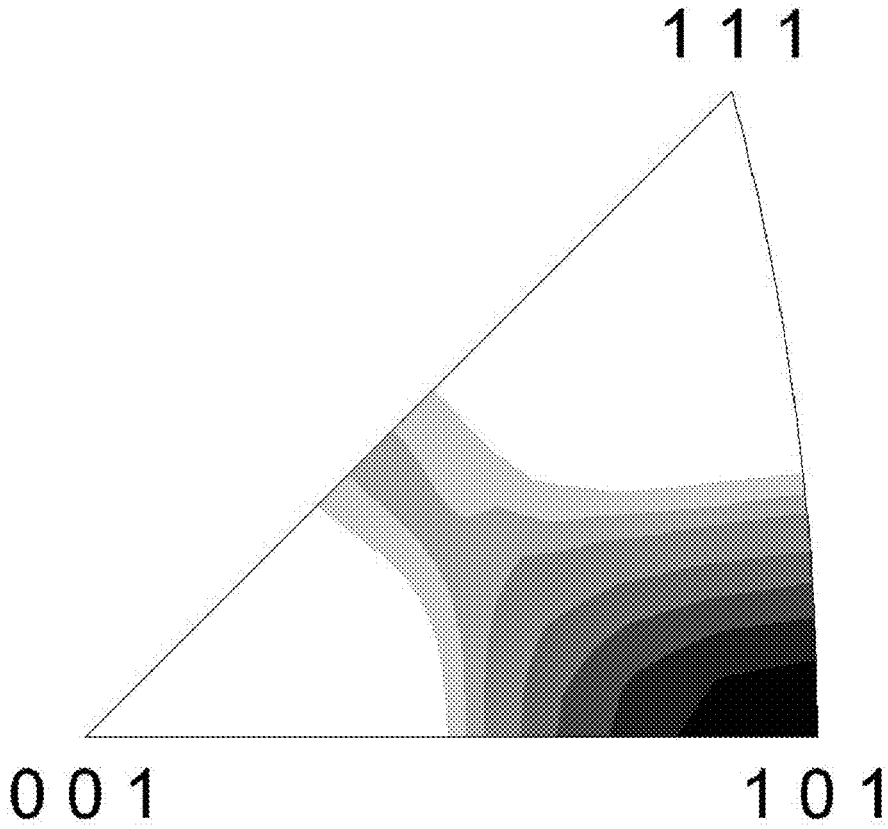
FIG. 2D is an inverse pole figure of a copper alloy material in Example 4.
Figure 3A:
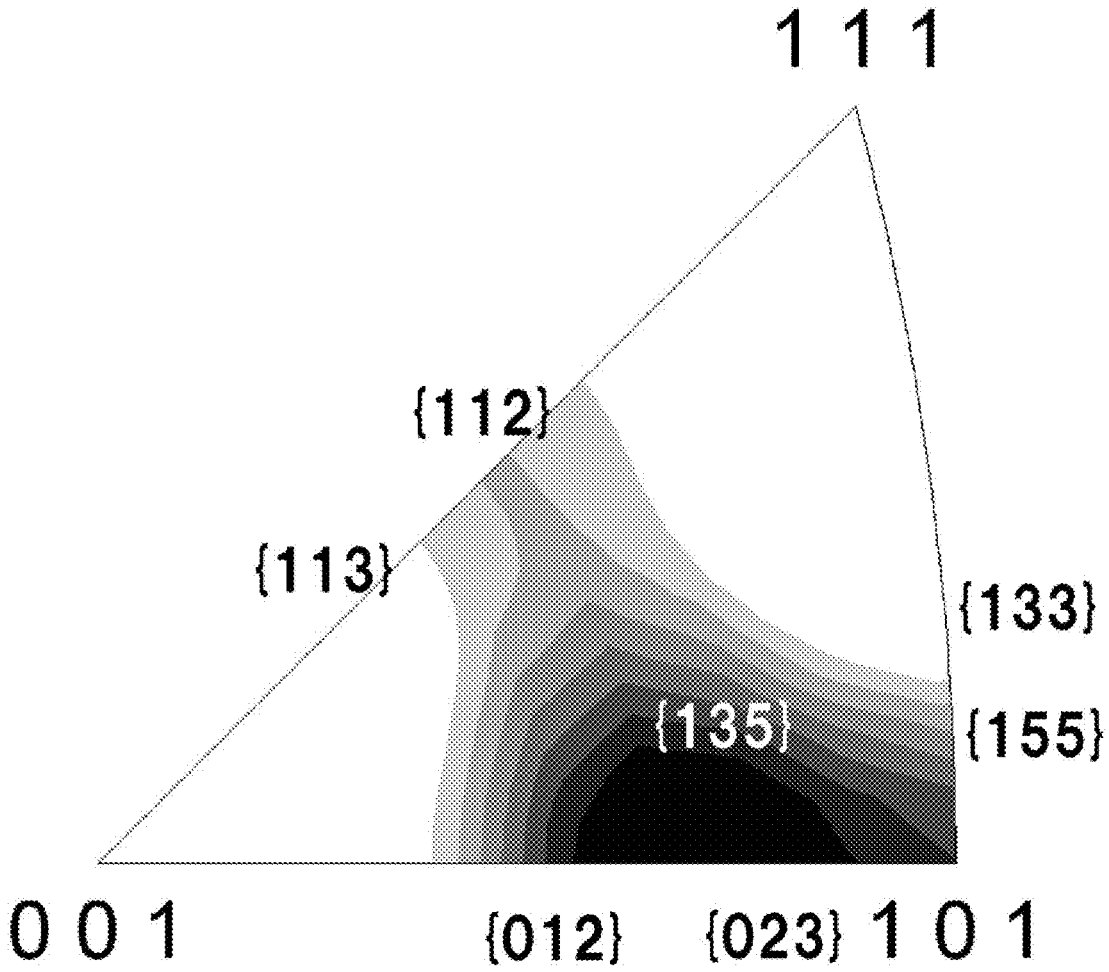
FIG. 3A is an inverse pole figure of a copper alloy material in comparative example 1.
Figure 3B:
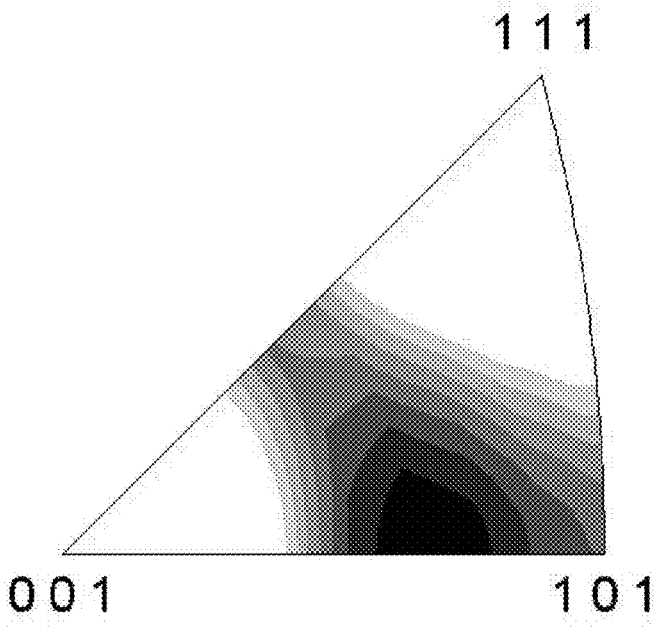
FIG. 3B is an inverse pole figure of a copper alloy material in comparative example 2.
Figure 3C:
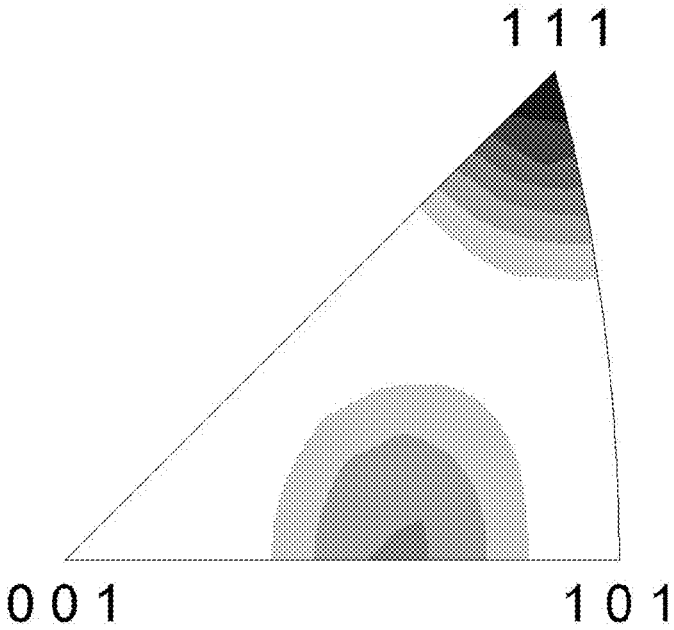
FIG. 3C is an inverse pole figure of a copper alloy material in comparative example 3.
Figure 3D:
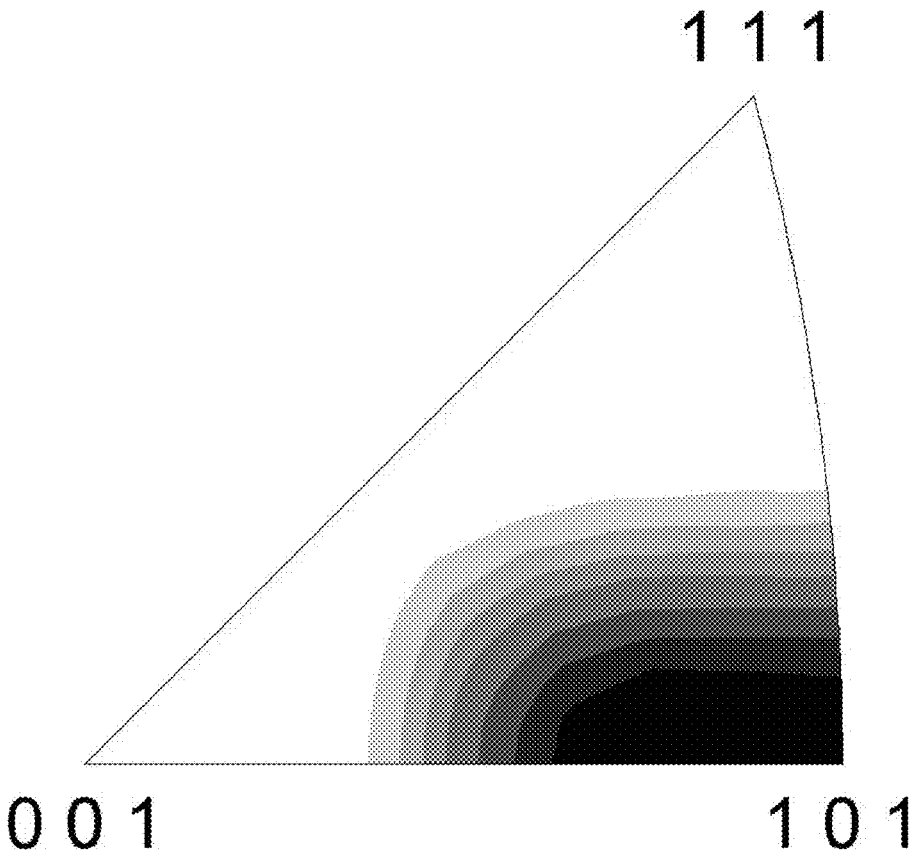
FIG. 3D is an inverse pole figure of a copper alloy material in comparative example 4.

The diffraction intensity distribution in the figures shows that the diffraction intensity is increased in accordance with an increase in darkness of colored part. In FIGS. 2A and 3A, a position of each crystal face was shown in the diffraction intensity distribution. With referring to FIGS. 2A to 2D, it is understood that all of the copper alloy materials in the Examples 1 to 4 satisfy following condition.

In other words, any of the copper alloy materials in the Examples 1 to 4 necessarily comprises {011}, at least one {1nn} (n is an integer, n≧1), at least one {11m} (m is an integer, m≧1), at least one crystal face selected from a group consisted of {023}, {012}, and {135}, and the diffraction intensities of the crystal faces satisfy the relationships of {011}>{155}>{133}, {011}>{023}>{012}, and {011}>{135}>{112} in the inverse pole figure of the crystal faces parallel to the rolled surface.

On the other hand, none of the copper alloy material in the comparative examples 1 to 4 satisfies the conditions satisfied by the Examples 1 to 4, i.e. the condition of the crystal face included in the rolled surface and the condition of the relationship of the diffraction intensities of the crystal faces.

Similarly to the Examples 1 to 4, any of the copper alloy materials in the Examples 5 to 8 necessarily comprises {011}, at least one {1nn} (n is an integer, n≧1), at least one {11m} (m is an integer, m≧1), at least one crystal face selected from a group consisted of {023}, {012}, and {135}, and the diffraction intensities of the crystal faces satisfy the relationships of {011}>{155}>{133}, {011}>{023}>{012}, and {011}>{135}>{112} in the inverse pole figure of the crystal faces parallel to the rolled surface. However, none of the copper alloy material in the comparative examples 5 to 8 satisfied the conditions satisfies by the Examples 1 to 4, i.e. the condition of the crystal face included in the rolled surface and the condition of the relationship of the diffraction intensities of the crystal faces.

Herein, the inverse pole figures of the Examples 5 to 8 and the comparative examples 5 to 8 are omitted, since they are respectively similar to those of the Examples 1 to 4 and the comparative examples of 1 to 4. Further, the X-ray diffraction measurement was carried out for the copper alloy materials in the Examples 1 to 8 and the comparative examples 1 to 8, and the inverse pole figures of the crystal faces parallel to the rolled surface was result were substantially similar to those obtained by the EBSD method. Therefore, the inverse pole figures obtained by the X-ray diffraction measurement are omitted. In addition, there are several crystal faces that cannot be directly measured due to extinction rule in the crystal faces parallel to the rolled surface. Therefore, so as to indirectly measure the crystal faces that cannot be directly measure, the measurement was carried out by inclining the sample with respect to the other crystal faces that can be directly measured.

From the measuring results of the Examples 1 to 8 and the comparative examples 1 to 8, it is shown that it is possible to control respective kinds and diffraction intensities of the plural crystal faces formed to be parallel to the rolled surface of the copper alloy material by controlling the area reduction ratio of the cold rolling pass next to one cold rolling pass not to be greater than the one cold rolling pass in the plural cold rolling passes in the cold rolling process even when the compositions of the copper alloy materials are different from each other.

(Characteristics Evaluation of the Copper Alloy Materials in the Examples and the Comparative Examples)

Concerning each of the copper alloy materials in the Examples and comparative examples, tensile strength, 0.2% proof stress and bending characteristics were evaluated. The tensile strength and the 0.2% proof stress were measured by carrying out a tension-test in accordance with JIS Z2241. The bending characteristics test was carried out by using a specimen taken from the copper alloy material and by determining a direction parallel to a rolling direction of the specimen as a bending axis in accordance with JIS H3110, H3130 and Japan Copper and Brass Association technical standard JCBA T307. As to the test condition of the bending characteristics test, the bending characteristics test was carried out for both of the case where a bending radius R=0.1 mm and a specimen thickness t is 0.2 mm (R/t=0.5) and the case where a bending radius R=0.2 mm and a specimen thickness t is 0.2 mm (R/t=1).

TABLE 3 shows evaluation results of the tensile strength, 0.2% proof stress and bending characteristics of the respective copper alloy materials in the Examples and the comparative examples. In TABLE 3, the evaluation of the bending characteristics is expressed as "××" when a crack is large, "×" when the crack is small, "Δ" when the crack is fine, and "○" when no crack is observed.

TABLE 3

| | Tensile strength N/mm$^2$ | 0.2% proof stress N/mm$^2$ | R/t = 1 R (bending radius) = 0.2 mm T (thickness) = 0.2 mm | R/t = 0.5 R (bending radius) = 0.1 mm T (thickness) = 0.2 mm |
|---|---|---|---|---|
| Example 1 | 802 | 730 | ○ | ○ |
| Comparative Example 1 | 803 | 731 | x~Δ | x~xx |
| Example 2 | 810 | 744 | ○ | ○ |
| Comparative Example 2 | 813 | 745 | x~Δ | xx |
| Example 3 | 812 | 748 | ○ | ○ |
| Comparative Example 3 | 810 | 748 | x | xx |
| Example 4 | 826 | 754 | ○ | ○ |

TABLE 3-continued

| | Tensile strength N/mm$^2$ | 0.2% proof stress N/mm$^2$ | R/t = 1 R (bending radius) = 0.2 mm T (thickness) = 0.2 mm | R/t = 0.5 R (bending radius) = 0.1 mm T (thickness) = 0.2 mm |
|---|---|---|---|---|
| Comparative Example 4 | 822 | 754 | x | xx |
| Example 5 | 700 | 631 | ○ | ○ |
| Comparative Example 5 | 703 | 635 | Δ | x~Δ |
| Example 6 | 724 | 636 | ○ | ○ |
| Comparative Example 6 | 726 | 634 | Δ | x~Δ |
| Example 7 | 744 | 652 | ○ | ○ |
| Comparative Example 7 | 745 | 652 | Δ | x |
| Example 8 | 765 | 678 | ○ | ○ |
| Comparative Example 8 | 766 | 678 | x~Δ | x |

Crack (large): xx
Crack (small): x
Crack (fine): Δ
No crack: ○

With referring to TABLE 3, the copper alloy materials in the Examples 1 to 8 are excellent in all of high strength, high proof stress and bending characteristics.

In the copper alloy materials in the Examples 1 to 8, it is possible to provide the copper alloy material excellent in all of the high strength, high proof stress and bending characteristics by controlling the conditions of the plural cold rolling passes in the cold rolling process such that the area reduction ratio of the cold rolling pass next to one cold rolling pass is not greater than the one cold rolling pass. This mechanism is assumed as follows.

Namely, the copper and copper alloy tend to rotate the crystal face to {011} by the rolling process. Therefore, it is assumed that it is possible to carry out the cold rolling process without excessively processing the copper or copper alloy in the cold rolling per cold rolling pass by controlling the conditions of the plural cold rolling passes in the cold rolling process such that the area reduction ratio of the cold rolling pass next to one cold rolling pass is not greater than the one cold rolling pass in the plural cold rolling passes. On the other hand, when the cold rolling process is controlled such that the area reduction ratio of the cold rolling pass next to one cold rolling pass is greater than the one cold rolling pass, there is a case that the degree of working of the cold rolling per cold rolling pass is too high. For this case, there is the case that the crystal rotated to {011} from one cold rolling pass to another cold rolling pass next to the one cold rolling pass may be rotated to another crystal face due to the excessively high degree of working.

As described above, it is assumed that it is possible to provide the copper alloy material excellent in all of the high strength, high proof stress and bending characteristics by controlling the conditions of the plural cold rolling passes in the cold rolling process such that the area reduction ratio of the cold rolling pass next to one cold rolling pass is not greater than the one cold rolling pass as in the copper alloy materials in the Examples 1 to 8.

Figure 4A:
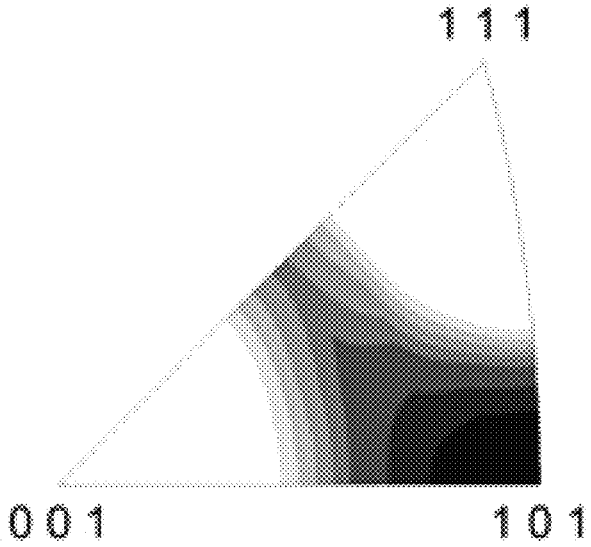
FIG. 4A is an inverse pole figure of the copper alloy material in Example 1.
Figure 4B:
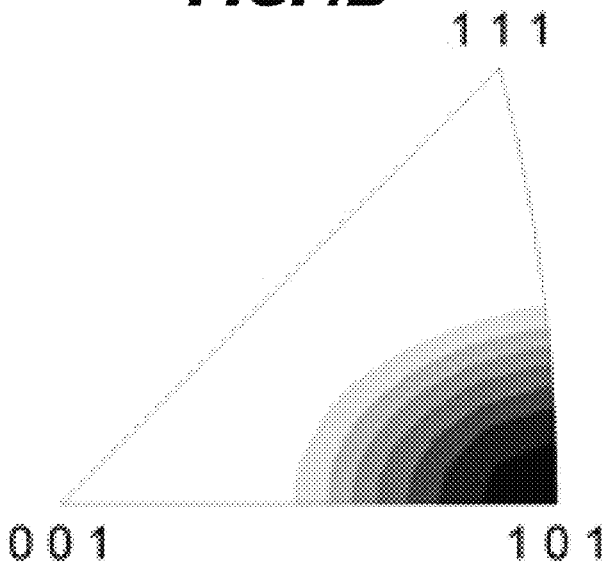
FIG. 4B is an inverse pole figure of the copper alloy material in Example 1 after bending process.

FIG. 4A is an inverse pole figure of the copper alloy material in Example 1, and FIG. 4B is an inverse pole figure of the copper alloy material in Example 1 after bending process.

Figure 5A:
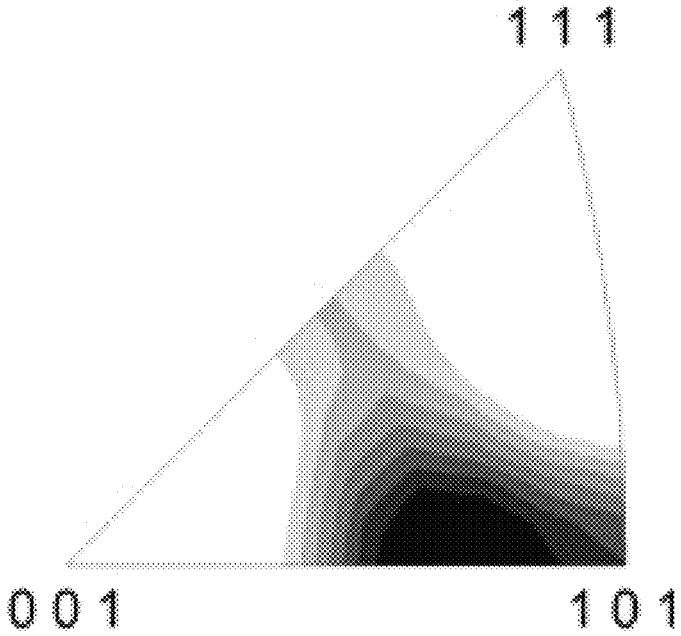
FIG. 5A is an inverse pole figure of the copper alloy material in comparative example 1.
Figure 5B:
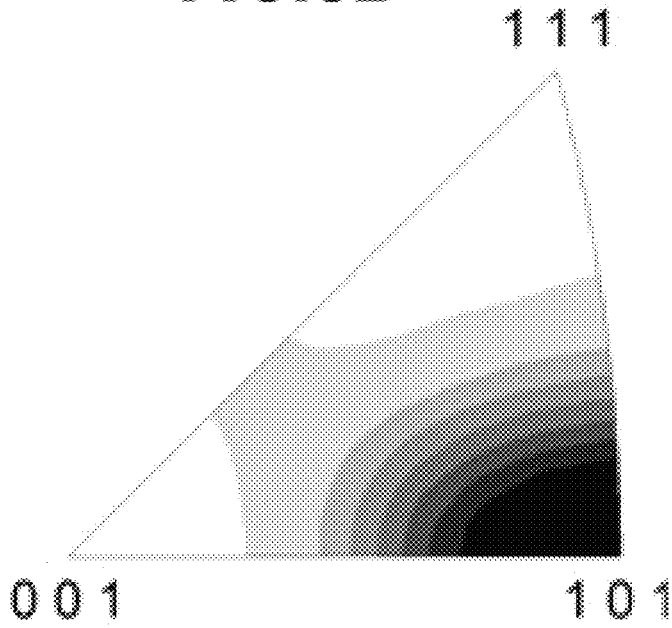
FIG. 5B is an inverse pole figure of the copper alloy material in comparative example 1 after bending process.

FIG. 5A is an inverse pole figure of the copper alloy material in comparative example 1, and FIG. 5B is an inverse pole figure of the copper alloy material in comparative example 1 after bending process.

At first, with referring to FIGS. 4A and 4B, in the copper alloy material in the Example 1, a part with high diffraction intensity in the inverse pole figure, more concretely, a region in vicinity of {101} in FIG. 4A, keeps the high diffraction intensity even after the bending work as shown in FIG. 4B. This means that substantially no rotation occurs in the crystal composing the copper alloy after the bending work in the copper alloy material in the Example 1.

Furthermore, although the diffraction was measured in vicinity of {113} and {112} with referring to FIG. 4A, no diffraction was measured in vicinity of {113} and {112} in FIG. 4B. This is because the diffraction measurement could not be carried out due to much accumulation of strains by the effect of plastic deformation caused by bending work (i.e. it is difficult to obtain the diffraction pattern of the part where the strains are much accumulated by the EBSD measurement). Furthermore, the Inventors observed the crystal faces in vicinity of {113} and {112} shows a wrinkled appearance after the bending work (i.e. it was observed that the surface was not cracked but wrinkles occur along a direction perpendicular to the bending direction as the appearance).

On the other hand, with referring to FIGS. 5A and 5B, in the copper alloy material in the comparative example 1, a part with high diffraction intensity in the inverse pole figure, more concretely, a region between {101} and {001} in FIG. 5A, rotates to {011} after the bending work as shown in FIG. 5B. Furthermore, although the diffraction was measured in vicinity of {113} and {112} with referring to FIG. 5A, the diffraction intensity was weakened in FIG. 5B. This is because the strains were much accumulated at the respective crystal faces at the part with the weak diffraction intensity similarly to the Example 1 (i.e. it was observed a surface appearance was wrinkled similarly to the Example 1). Similar tendency was observed in the Examples 2 to 8 and the comparative examples 2 to 8.

Based on the above, it is assumed that one of the reasons for providing the copper alloy materials in the Examples 1 to 8 with excellent characteristics in the high strength, high proof stress and bending characteristics is that the crystal face showing high diffraction intensity in the inverse pole figure before the bending work does not substantially rotate even after the bending work and that the wrinkles occur in the crystal face showing low diffraction intensity by the bending work in the Examples 1 to 8.

Although the invention has been described with respect to the specific embodiments for complete and clear disclosure, the appended claims are not to be therefore limited but are to be construed as embodying all modifications and alternative constructions that may occur to one skilled in the art which fairly fall within the basic teaching herein set forth.

What is claimed is:

1. A copper alloy material comprising:

a surface comprising a plurality of crystal faces parallel to the surface, the crystal faces including at least one crystal face selected from the group consisting of {011}, {1nn} (n is an integer, n≧1), {11m} (m is an integer, m≧1), {023}, {012}, and {135}, wherein diffraction intensities of the crystal faces in an inverse pole figure obtained by crystal diffraction measurement of the surface as a reference satisfy the relationships of:

{011}>{155}>{133},

{011}>{023}>{012}, and

{011}>{135}>{112}.

2. The copper alloy material according to claim 1 comprising:

Ni, Si, and the balance being Cu and inevitable impurities.

3. The copper alloy material according to claim 1 comprising:

at least one element selected from the group consisting of Zn, Sn and P; and

Ni, Si, and the balance being Cu and inevitable impurities.

4. A method for fabricating a copper alloy material comprising:

hot rolling process of hot rolling an ingot comprising a copper alloy to manufacture a sheet of the copper alloy;

cold rolling process of cold rolling the sheet;

solution treatment process of carrying out a solution treatment on the sheet after the cold rolling process; and finish cold rolling process of cold rolling the sheet after the solution treatment process, wherein the cold rolling process comprising cold rolling passes for plural times, wherein an area reduction ratio of the sheet in an initial cold rolling pass is greater than any of area reduction ratios of other cold rolling passes to produce a copper alloy material wherein diffraction intensities of the crystal faces in an inverse pole figure obtained by crystal diffraction measurement of the rolled surface as a reference satisfy the relationships of:

{011}>{155}>{133},

{011}>{023}>{012}, and

{011}>{135}>{112}.

5. The method for fabricating a copper alloy material according to claim 4, further comprising:

an aging treatment process of carrying out an aging treatment on the sheet after the finish cold rolling process.

6. The method for fabricating a copper alloy material according to claim 4, further comprising:

an aging treatment process of carrying out an aging treatment on the sheet after the solution treatment process.

7. The copper alloy material according to claim 1, wherein the surface is a rolled surface.

8. The copper alloy material according to claim 1, wherein the surface is a main surface.

9. The copper alloy material according to claim 7, wherein the rolled surface has been prepared by a rolling process which uses a reduction ratio of no more than 25% in a cold rolling step.

10. The copper alloy material according to claim 7, wherein the rolled surface has been prepared by a rolling process which uses a reduction ratio of 15-25% in a first cold rolling step.

* * * * *